US010796839B2

(12) United States Patent
Marketos et al.

(10) Patent No.: US 10,796,839 B2
(45) Date of Patent: Oct. 6, 2020

(54) RADIO FREQUENCY TRANSFORMER WINDING COIL STRUCTURE

(71) Applicant: PPC Broadband, Inc., East Syracuse, NY (US)

(72) Inventors: Leon Marketos, Auburn, NY (US); Erdogan Alkan, Manlius, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 151 days.

(21) Appl. No.: 15/935,458

(22) Filed: Mar. 26, 2018

(65) Prior Publication Data

US 2018/0211757 A1 Jul. 26, 2018

Related U.S. Application Data

(62) Division of application No. 13/948,315, filed on Jul. 23, 2013, now Pat. No. 9,953,756.

(60) Provisional application No. 61/703,802, filed on Sep. 21, 2012.

(51) Int. Cl.

| | |
|---|---|
| ***H01F 27/28*** | (2006.01) |
| ***H01F 41/06*** | (2016.01) |
| ***H01F 27/00*** | (2006.01) |
| ***H01F 27/255*** | (2006.01) |
| ***H01F 41/08*** | (2006.01) |
| ***H01F 41/02*** | (2006.01) |
| *H01F 17/06* | (2006.01) |
| *H01F 3/10* | (2006.01) |

(52) U.S. Cl.

CPC ..... *H01F 27/006* (2013.01); *H01F 27/255* (2013.01); *H01F 27/2895* (2013.01); *H01F 41/0206* (2013.01); *H01F 41/06* (2013.01); *H01F 41/08* (2013.01); *H01F 17/062* (2013.01); *H01F 2003/106* (2013.01); *Y10T 29/49071* (2015.01)

(58) Field of Classification Search

CPC .. H01F 27/006; H01F 27/255; H01F 27/2895; H01F 41/0206; H01F 41/06–08; H01F 17/062; H01F 17/06; H01F 2003/106; H01F 27/324; Y10T 29/49071

USPC ..... 336/188, 229, 222, 192; 29/602.1, 605

See application file for complete search history.

(56) References Cited

U.S. PATENT DOCUMENTS

| | | | |
|---|---|---|---|
| 1,133,750 | A | 3/1915 | Shaw |
| 1,231,193 | A | 6/1917 | Powers |

(Continued)

FOREIGN PATENT DOCUMENTS

| | | | |
|---|---|---|---|
| EP | 0475522 | A1 | 3/1992 |
| EP | 0499311 | A1 | 8/1992 |

OTHER PUBLICATIONS

Extended European Search Report dated Aug. 4, 2016, European Application No. 13840038, filed Sep. 20, 2013, pp. 1-12.

(Continued)

*Primary Examiner* — Mang Tin Bik Lian

(74) *Attorney, Agent, or Firm* — Mh2 Technology Law Group LLP

(57) ABSTRACT

An RF transformer is provided. The RF transformer includes a ferrite core and a winding coil structure formed around the ferrite core. The winding coil structure is in electrical contact with a center portion of the ferrite core. The winding coil structure is essentially electrically and physically spaced from external portions of the ferrite core.

27 Claims, 13 Drawing Sheets

(56) References Cited

U.S. PATENT DOCUMENTS

| | | | | |
|---|---|---|---|---|
| 3,413,574 | A * | 11/1968 | Schroeder | H04B 1/581 333/4 |
| 4,173,742 | A * | 11/1979 | Lehmann | H01C 21/00 333/100 |
| 4,551,700 | A | 11/1985 | Waldemar | |
| 4,975,672 | A | 12/1990 | McLyman | |
| 5,182,537 | A * | 1/1993 | Thuis | H01F 30/16 336/180 |
| 5,331,271 | A * | 7/1994 | Thuis | H01F 27/38 323/355 |
| 5,390,349 | A | 2/1995 | Joshi et al. | |
| 5,473,300 | A | 12/1995 | Watson | |
| 5,677,651 | A | 10/1997 | Crane | |
| 5,717,373 | A * | 2/1998 | Vachris | H01F 27/2895 336/206 |
| 5,929,738 | A * | 7/1999 | Orlando | H01F 19/04 336/12 |
| 7,724,118 | B1 | 5/2010 | Chen | |
| 2003/0030534 | A1 | 2/2003 | Gu et al. | |
| 2004/0022294 | A1* | 2/2004 | Yamamori | H01F 27/324 372/61 |
| 2004/0119577 | A1 | 6/2004 | Weger | |
| 2005/0146326 | A1 | 7/2005 | Li | |
| 2005/0162237 | A1 | 7/2005 | Yamashita | |
| 2011/0167869 | A1* | 7/2011 | Geers | B01D 53/002 62/637 |
| 2011/0234352 | A1 | 9/2011 | MacLennan | |
| 2012/0092112 | A1 | 4/2012 | McClelland et al. | |
| 2014/0266536 | A1* | 9/2014 | Lu | H01F 27/2895 336/178 |

OTHER PUBLICATIONS

Partial European Search Report dated Apr. 19, 2016, European Application No. 13840038.7, filed Sep. 20, 2013, pp. 1-6.

Park, J et al., "Ferrite-Based Integrated Planar Inductors and Transformers", IEEE Trans. Magnetics, Sep. 1997, vol. 33, No. 5, pp. 3322-3324, ISSN 0018-9464 [online], retrieved from the Internet Jan. 14, 2014, http://www.mems.gatech.edu/msmawebsite_2006/publications/publication_list_files/1997/Ferrite-Based%20Integrated%20Planar%20Inductors%20and%20Transformers%20Fabricated%20at%20Low%20Temperature.pdf; pp. 3322-3324.

ISR: PCT/US13/60846: International Search Report and Written Opinion; dated Mar. 10, 2014, 7 pages.

Park, J et al. 'Ultralow-Profile Micromachines Power Inductors With Highly Laminated Ni/Fe Cores: Application to Low-Megahertz DC-DC Converters', IEEE Trans. Magnetics, Sep. 1997, vol. 39, No. 5, pp. 3184-3186, ISSN 0018-9464 [online], [retrieved on Jan. 14, 2014]. Retrieved from the Internet: <URL: http://www.mems.gatech.edu/msma/publications/2003/Ultra-low-profil0/020micromachined%20power%20inductors%20with%2Ohighly°/0201aminated%20NiFe%20cores%20application%20to%20low%20MHz%20DC-DC%20converters.pdf> <DOI: 10.1109/TMAG.2003.816051>; p. 3184.

* cited by examiner

RADIO FREQUENCY TRANSFORMER WINDING COIL STRUCTURE

CROSS-REFERENCE TO RELATED APPLICATIONS

This application is a divisional of U.S. patent application Ser. No. 13/948,315, filed Jul. 23, 2013, which claims priority to U.S. Provisional Application Ser. No. 61/703,802 filed on Sep. 21, 2012.

BACKGROUND

Technical Field

The present invention relates to RF transformers and, more particularly, an RF transformer with a unique winding structure.

Related Art

High bandwidth components are useful for a variety of purposes, including operation with a wide spectrum of frequencies. Various materials used in construction of high bandwidth components may result in trade off of various parameters. A trade off of various parameters may cause a decrease in performance. Accordingly, there exists a need in the art to overcome at least some of the deficiencies and limitations described herein above.

SUMMARY

The present invention provides a structure for use with RF components that offers improved performance.

A first object of the present invention provides an RF transformer including: a ferrite core; and a winding coil structure formed around the ferrite core, wherein the winding coil structure is in electrical contact with a center portion of the ferrite core, and wherein the winding coil structure is essentially electrically and mechanically spaced from external portions of the ferrite core.

A second object of the present invention provides an RF transformer including: a ferrite core structure comprising a plurality of ferrite cores; and a winding coil structure formed around the ferrite core structure, wherein said winding coil structure is in electrical contact with a center portion of each ferrite core of the plurality of ferrite cores, and wherein the winding coil structure is essentially electrically and physically spaced from external portions of each the ferrite core.

A third object of the present invention provides a method for forming an RF transformer, the method including: forming a ferrite core; and forming a winding coil structure around the ferrite core, wherein the winding coil structure is in electrical contact with a center portion of the ferrite core, and wherein the winding coil structure is essentially electrically and physically spaced from external portions of the ferrite core.

A fourth object of the present invention provides a method for forming an RF transformer, the method including: forming a ferrite core structure comprising a plurality of ferrite cores; and forming a winding coil structure around the ferrite core structure, wherein the winding coil structure is in electrical contact with a center portion of each ferrite core of the plurality of ferrite cores, and wherein the winding coil structure is essentially electrically and physically spaced from external portions of each ferrite core.

The foregoing and other features of the invention will be apparent from the following more particular description of various embodiments of the invention.

DESCRIPTION OF THE DRAWINGS

The present invention will be more fully understood and appreciated by reading the following Detailed Description in conjunction with the accompanying drawings, in which.

DETAILED DESCRIPTION

Figure 1A:
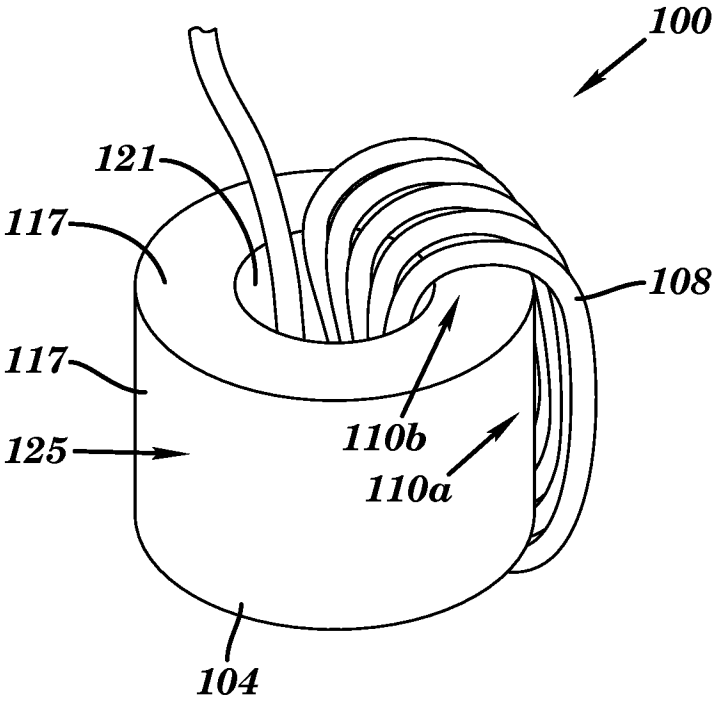
FIG. 1A is a perspective view of a radio frequency (RF) transformer, in accordance with embodiments of the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., which are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a," "an," and "the" include plural referents, unless the context clearly dictates otherwise.

Referring now to the drawings, wherein like reference numerals refer to like parts throughout, there is seen in FIG. 1A a perspective view of a radio frequency (RF) transformer 100, in accordance with embodiments of the present invention. RF transformer 100 may include a ferrite core 104 and a winding (coil) structure 108. Ferrite core 104 may include multiple ferrite material types arranged in a non-uniform manner. Winding structure 108 is in electrical contact with interior surface 121 of ferrite core 104. RF transformer 100 may be formed such that air gaps 110*a* and 110*b* are formed between winding structure 108 and an exterior surface 117 of ferrite core 104. Air gaps 110*a* and 110*b* essentially electrically and physically space winding structure 108 from exterior surface 117 of ferrite core 104. Additionally, spacers (e.g., spacers 120 in FIG. 1B as described, infra) may be strategically placed between winding structure 108 and ferrite core 104. Spacers 120 essentially electrically and physically space winding structure 108 from exterior surface 117 of ferrite core 104. Alternatively, ferrite core 104 may include an electrically insulative material 125 formed over an exterior surface 117 of ferrite core 104. The insulative material 125 is not formed over interior surface 121 of the ferrite core 104. Electrically insulative material 125 electrically and physically spaces winding structure 108 from exterior surface 117 of ferrite core 104. Winding structure 108 includes turns of a relatively fine gauge insulated wire (e.g., copper) installed on ferrite core 104 to form a group of windings of a specified number of turns and orientation. RF transformer 100 enables a unique combination of performance parameters such as, inter alia:

1. Conveyance of RF signals along an intended path (i.e., insertion loss).
2. A match to system impedance (i.e., return loss). In specific embodiments, a minimization of signal leakage among ports (i.e., isolation).
3. A maintenance of proper operation at low frequencies and cold temperatures (i.e., significantly affected by a specific ferrite material used).
4. Ultimate operation at high frequencies (i.e., significantly affected by specific ferrite material used and a winding arrangement/parasitics).
5. An ability to withstand high signal levels without producing unwanted signals (i.e., intermodulation).
6. An ability to withstand high magnetic excitation without degraded performance (surge).

RF transformer 100 enables manipulation of winding structure 108 with respect to ferrite core 104. At relatively low frequencies, a coupling of energy is magnetic and facilitated by the ferrite (of ferrite core 104). As a frequency rises through approximately 300 MHz, an effectiveness of the ferrite magnetic coupling decreases and a dominant coupling occurs via a capacitive (proximity) coupling among the windings. At the higher frequencies (i.e., greater than about 300 MHz), presence of the ferrite may add to parasitic losses. RF transformer 100 provides an ability to blend multiple types of ferrite materials in order to manage frequency performance at high and low frequencies. Additionally, RF transformer 100 provides an ability to generate portions of winding structure 108 that are not closely coupled (i.e., spaced away from) to ferrite core 104. Generating portions of winding structure 108 that are not closely coupled (i.e., spaced away from) to ferrite core 104 may be accomplished by using individual pieces of material (e.g., ferrous or non-ferrous, conductive or nonconductive) such as spacers situated between ferrite core 104 and winding structure 108 and/or within winding structure 108.

Figure 1C:
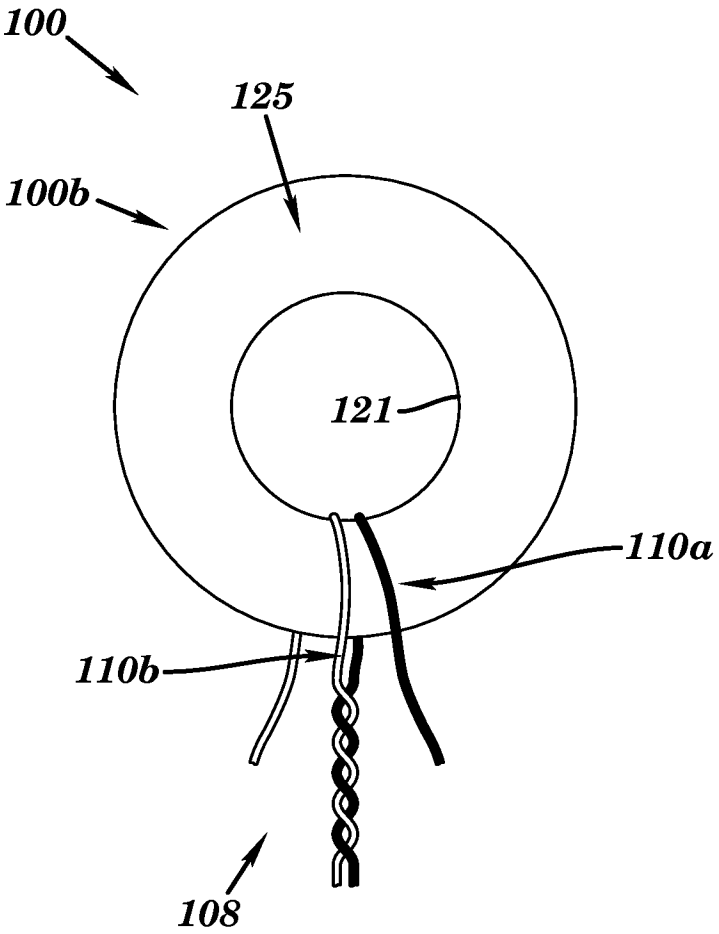
FIG. 1C is a top view of the RF transformer of FIG. 1A, in accordance with embodiments of the present invention.
Figure 1B:
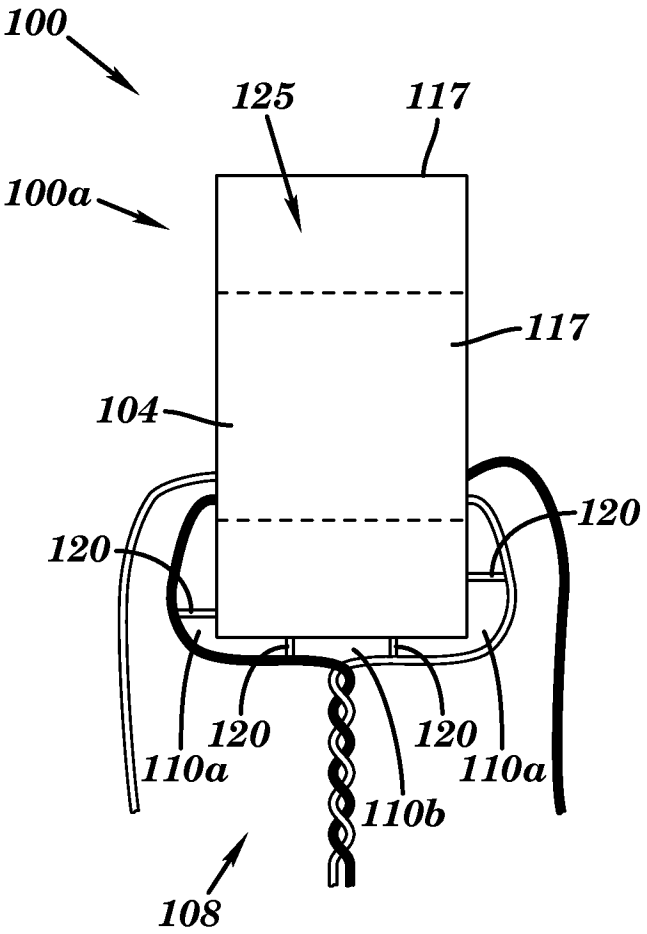
FIG. 1B is a side view of the RF transformer of FIG. 1A, in accordance with embodiments of the present invention.

Referring further to FIG. 1B, there is seen a side view 100*a* of RF transformer 100 of FIG. 1A, in accordance with embodiments of the present invention. FIG. 1B illustrates spacers 120 used to separate winding structure 108 from exterior surface 117 of core structure 104. Spacers 120 may comprise any type of operable spacers that include any size, shape, and/or material. For example, spacers 120 may comprise plastic, fiberglass, an insulator material, a dielectric material, etc.

Referring further to FIG. 1C, there is seen a top view 100*b* of RF transformer 100 of FIG. 1A, in accordance with embodiments of the present invention.

Figure 2A:
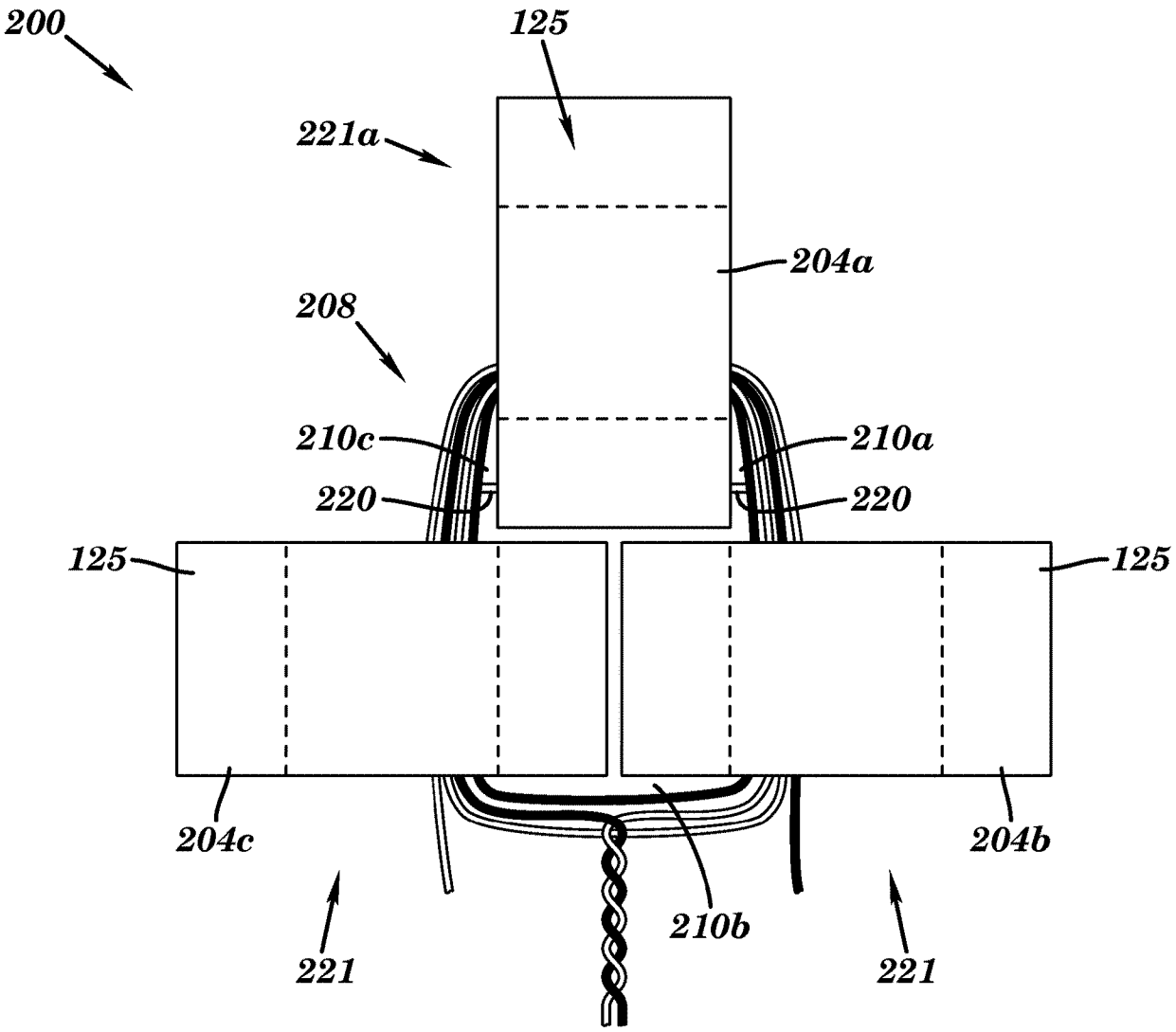
FIG. 2A is a side view of a multicore RF transformer, in accordance with embodiments of the present invention.

Referring further to FIG. 2A, there is seen a side view of a multicore RF transformer 200, in accordance with embodiments of the present invention. Multicore RF transformer 200 comprises multiple ferrite cores 204*a*, 204*b*, and 204*c* and a winding (coil) structure 208 strategically formed around ferrite cores 204*a*, 204*b*, and 204*c*. Ferrite cores 204*a*, 204*b*, and 204*c* may each include multiple ferrite material types arranged in a non-uniform manner. Each of ferrite cores 204*a*, 204*b*, and 204*c* may comprise a same size, shape, and material. Alternatively, each of ferrite cores 204*a*, 204*b*, and 204*c* may comprise a different size, shape, and/or material. Winding structure 208 is in electrical contact with interior surfaces of ferrite cores 204*a*, 204*b*, and 204*c*. Multicore RF transformer 200 may be formed such that air gaps 210*a*, 210*b*, and 210*c* are formed between winding structure 208 and exterior surfaces of ferrite cores 204*a*, 204*b*, and 204*c*. Air gaps 210*a*, 210*b*, and 210*c* essentially electrically and physically space winding structure 208 from exterior surfaces of ferrite cores 204*a*, 204*b*, and 204*c*. Additionally, spacers 220 may be strategically placed between winding structure 208 and ferrite cores 204*a*, 204*b*, and 204*c*. The spacers essentially electrically and physically space winding structure 208 from exterior surfaces of ferrite cores 204*a*, 204*b*, and 204*c*. Alternatively and/or additionally, ferrite cores 204*a*, 204*b*, and 204*c* may each include an electrically insulative material 125 formed over exterior surfaces of ferrite cores 204*a*, 204*b*, and 204*c*. The insulative material 125 is not formed over interior surfaces 221 of ferrite cores 204*a*, 204*b*, and 204*c*. Electrically insulative material 125 electrically and physically spaces winding structure 208 from exterior surfaces of ferrite cores 204*a*, 204*b*, and 204*c*.

The use of multiple ferrite cores (e.g., ferrite cores 204*a*, 204*b*, and 204*c*) allows potential selection of multiple different types of ferrite thereby allowing a designer additional flexibility to blend desirable properties of different ferrite material types. The use of multiple ferrite cores of a same type of ferrite material may additionally segmenting of a ferrite medium. Additionally, multicore RF transformer 200 enables an overall winding structure comprising a unique shape offering enhanced parasitics thereby allowing a high frequency performance. Generating portions of winding structure 208 that are not closely coupled (i.e., spaced away from) to ferrite cores 204*a*, 204*b*, and 204*c* may be accomplished by selecting different ferrite sizes or shapes and/or arranging ferrite cores 204*a*, 204*b*, and 204*c* in such a way as to create gaps between winding structure 208 and ferrite cores 204*a*, 204*b*, and 204*c* at specified areas.

Figure 2B:
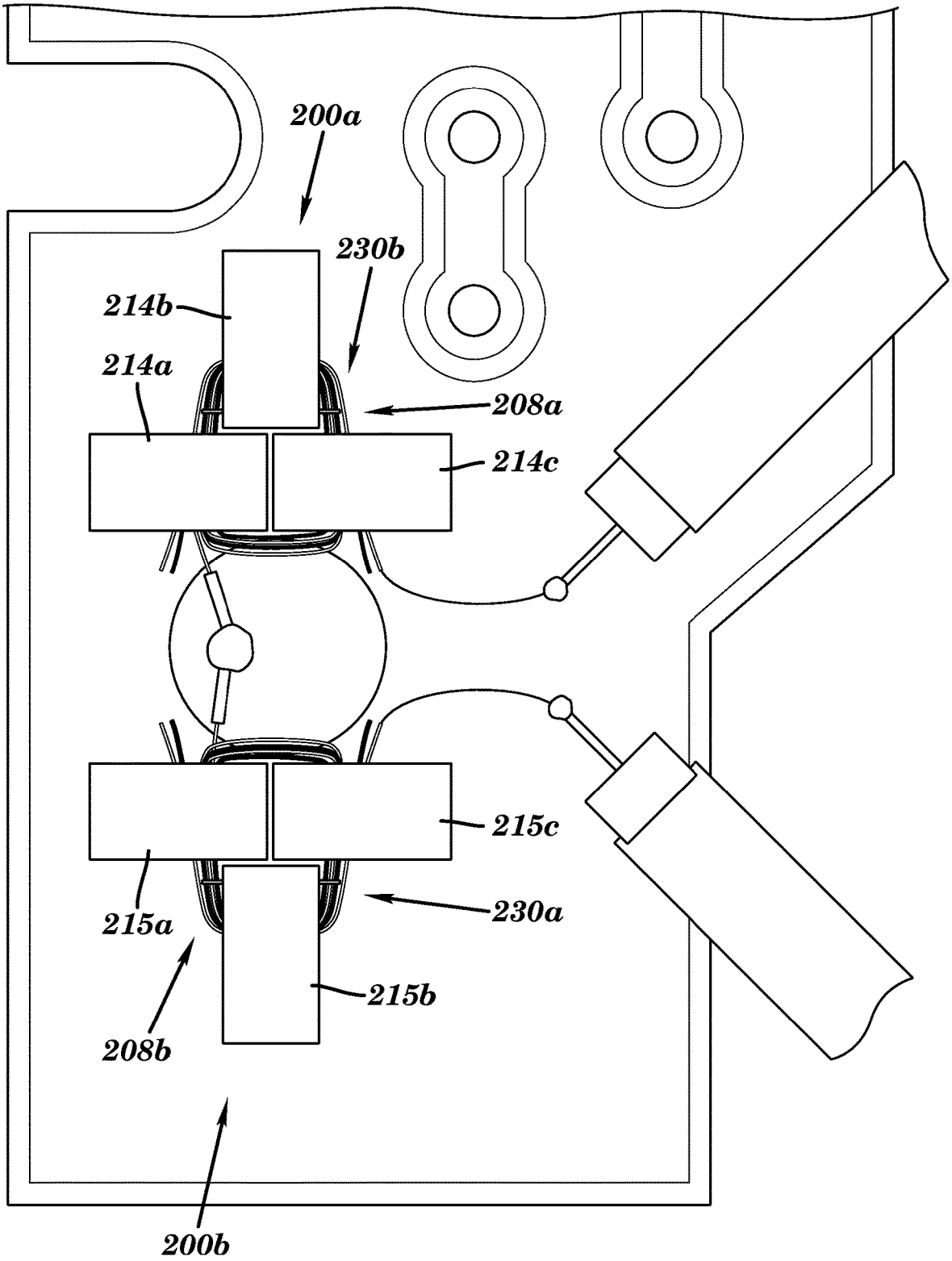
FIG. 2B is a perspective view of a multiple multicore RF transformers, in accordance with embodiments of the present invention.

Referring further to FIG. 2B, there is seen a perspective view of a multicore RF transformer 200*a* connected to a multicore RF transformer 200*b*, in accordance with embodiments of the present invention. Multicore RF transformer 200*a* is electrically and physically connected to a multicore RF transformer 200*b*. Multicore RF transformer 200*a* comprises multiple ferrite cores 214*a*, 214*b*, and 214*c* and a winding (coil) structure 208*a* strategically formed around ferrite cores 214*a*, 214*b*, and 214*c*. Ferrite cores 214*a*, 214*b*, and 214*c* may each include multiple ferrite material types arranged in a non-uniform manner. Each of ferrite cores 214*a*, 214*b*, and 214*c* may comprise a same size, shape, and material. Alternatively, each of ferrite cores 214*a*, 214*b*, and 214*c* may comprise a different size, shape, and/or material. Winding structure 208*a* is in electrical contact with interior surfaces of ferrite cores 214*a*, 214*b*, and 214*c*. Multicore RF transformer 200 may be formed such that air gaps 230*a* are formed between winding structure 208*a* and exterior surfaces of ferrite cores 214*a*, 214*b*, and 214*c*. Air gaps 230*a* essentially electrically and physically space winding structure 208*a* from exterior surfaces of ferrite cores 214*a*, 214*b*, and 214*c*. Additionally, spacers (e.g., spacers 220 of FIG. 2A) may be strategically placed between winding structure 208*a* and ferrite cores 204*a*, 204*b*, and 204*c*. The spacers essentially electrically and physically space winding structure 208*a* from exterior surfaces of ferrite cores 214*a*, 214*b*, and 214*c*. Alternatively and/or additionally, ferrite cores 214*a*, 214*b*, and 214*c* may each include an electrically insulative material formed over exterior surfaces of ferrite cores 214*a*, 214*b*, and 214*c*. The insulative material is not formed over interior surfaces of ferrite cores 214*a*, 214*b*, and 214*c*. The electrically insulative material electrically and physically spaces winding structure 208*a* from exterior surfaces of ferrite cores 214*a*, 214*b*, and 214*c*. Multicore RF transformer 200*b* comprises multiple ferrite cores 215*a*, 215*b*, and 215*c* and a winding (coil) structure 208*b* strategically formed around ferrite cores 215*a*, 215*b*, and 215*c*. Ferrite 215*a*, 215*b*, and 215*c* may each include multiple ferrite material types arranged in a non-uniform manner. Each of ferrite cores 215*a*, 215*b*, and 215*c* may comprise a same size, shape, and material. Alternatively, each of ferrite cores 215*a*, 215*b*, and 215*c* may comprise a different size, shape, and/or material. Winding structure 208*b* is in electrical contact with interior surfaces of ferrite cores 215*a*, 215*b*, and 215*c*. Multicore RF transformer 200*b* may be formed such that air gaps 230*b* are formed between winding structure 208*b* and exterior surfaces of ferrite cores 215*a*, 215*b*, and 215*c*. Air gaps 230*b* essentially electrically and physically space winding structure 208*b* from exterior surfaces of ferrite cores 215*a*, 215*b*, and 215*c*. Additionally, spacers (e.g., spacers 220 of FIG. 2A) may be strategically placed between winding structure 208*b* and ferrite cores 215*a*, 215*b*, and 215*c*. The spacers essentially electrically and physically space winding structure 208*b* from exterior surfaces of ferrite cores 215*a*, 215*b*, and 215*c*. Alternatively and/or additionally, ferrite cores 215*a*, 215*b*, and 215*c* may each include an electrically insulative material formed over exterior surfaces of ferrite cores 215*a*, 215*b*, and 215*c*. The insulative material is not formed over interior surfaces of ferrite cores 215*a*, 215*b*, and 215*c*. The electrically insulative material electrically and physically spaces winding structure 208*b* from exterior surfaces of ferrite cores 215*a*, 215*b*, and 215*c*.

Figure 3:
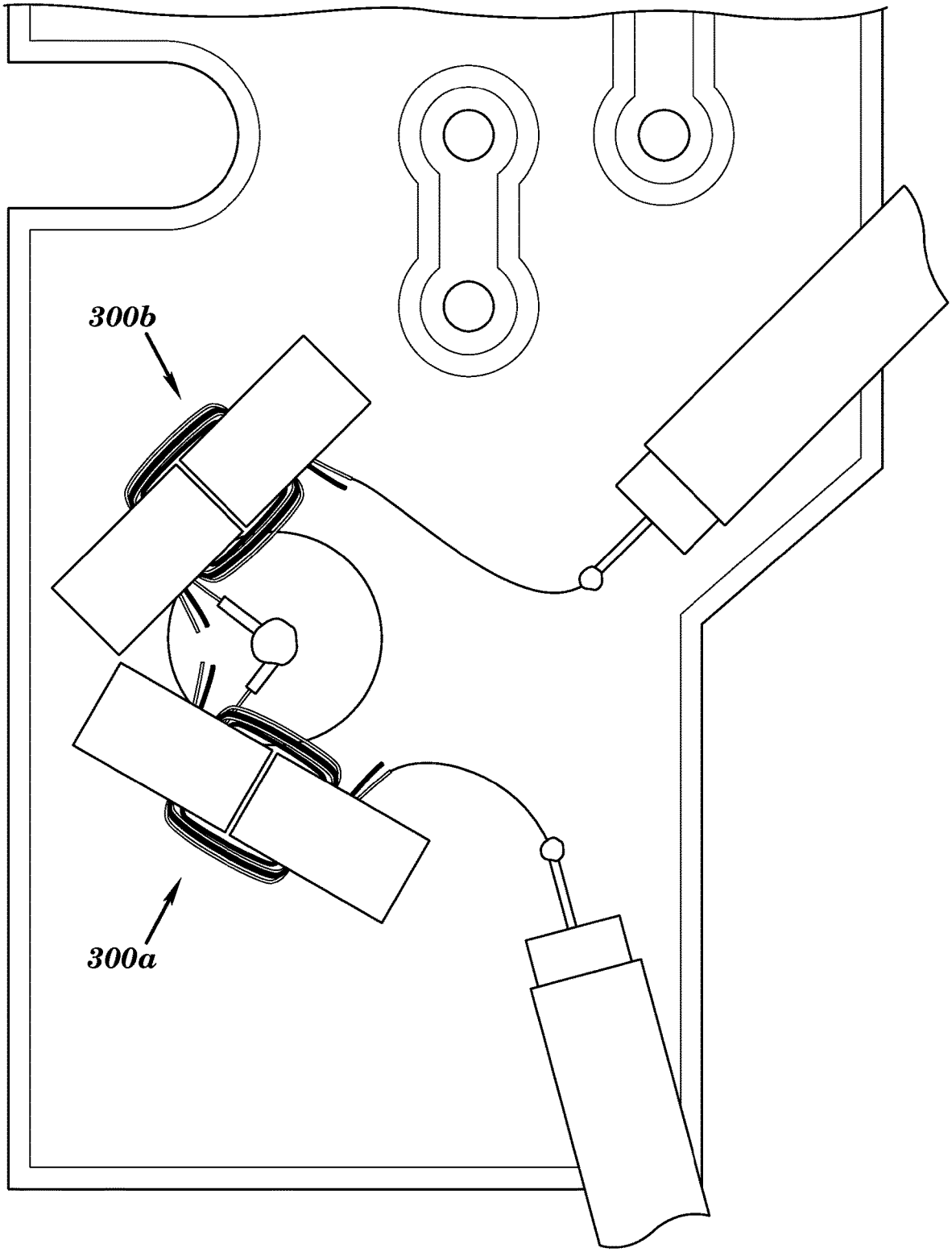
FIG. 3 is a perspective view of a multicore RF transformer 300*a* connected to another multicore RF transformer, in accordance with embodiments of the present invention.

Referring further to FIG. 3, there is seen a perspective view of a multicore RF transformer 300*a* connected to a multicore RF transformer 300*b*, in accordance with embodiments of the present invention. Multicore RF transformer 300*a* is electrically and physically connected to a multicore RF transformer 300*b*.

Figure 4:
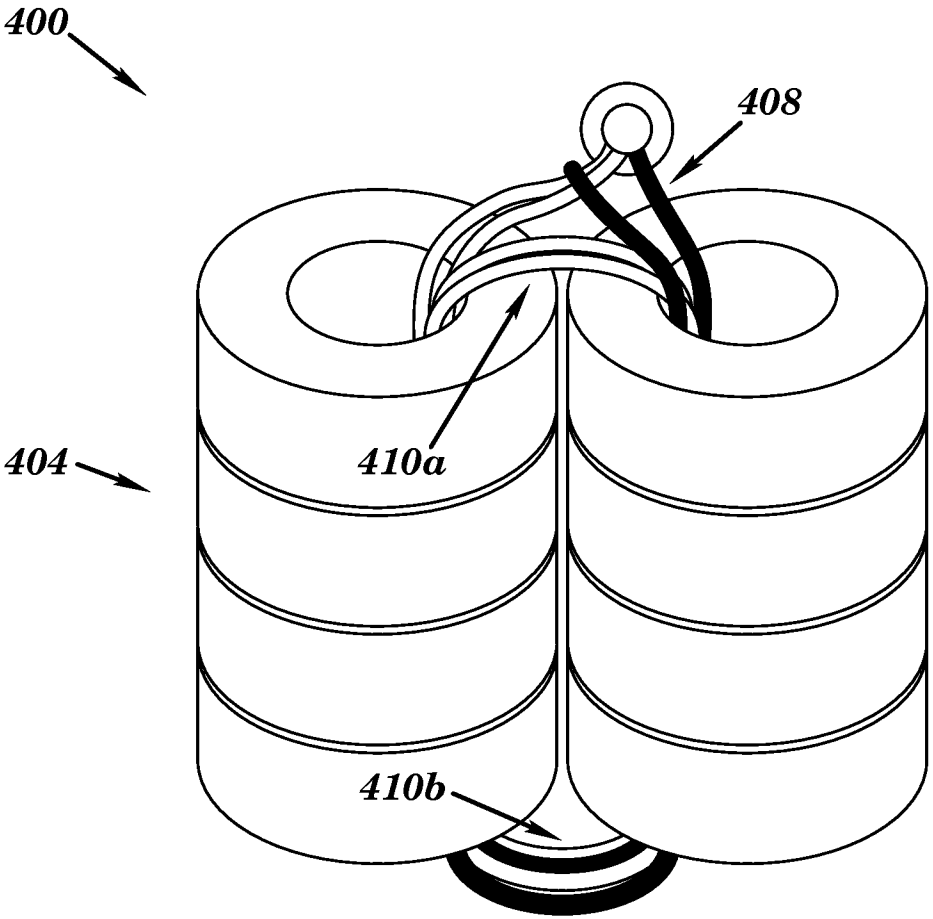
FIG. 4 is a perspective view of an alternative multicore RF transformer, in accordance with embodiments of the present invention.

Referring further to FIG. 4, there is seen a perspective view of a multicore RF transformer 400, in accordance with embodiments of the present invention. Multicore RF transformer 400 comprises multiple (i.e., eight) ferrite cores 404 and a winding (coil) structure 408 strategically formed around ferrite cores 404. Ferrite cores 404 may each include multiple ferrite material types arranged in a non-uniform manner. Each of ferrite cores 404 may comprise a same size, shape, and material. Alternatively, each of ferrite cores 404 may comprise a different size, shape, and/or material. Winding structure 408 is in electrical contact with interior surfaces of ferrite cores 404. Multicore RF transformer 400 may be formed such that air gaps 410*a* and 410*b* are formed between winding structure 408 and exterior surfaces of ferrite cores 404. Air gaps 410*a* and 410*b* essentially electrically and physically space winding structure 408 from exterior surfaces of ferrite cores 404. Additionally, spacers (e.g., spacers of FIG. 220 of FIG. 2A) may be used to electrically and physically space winding structure 408 from exterior surfaces of ferrite cores 404.

Figure 5:
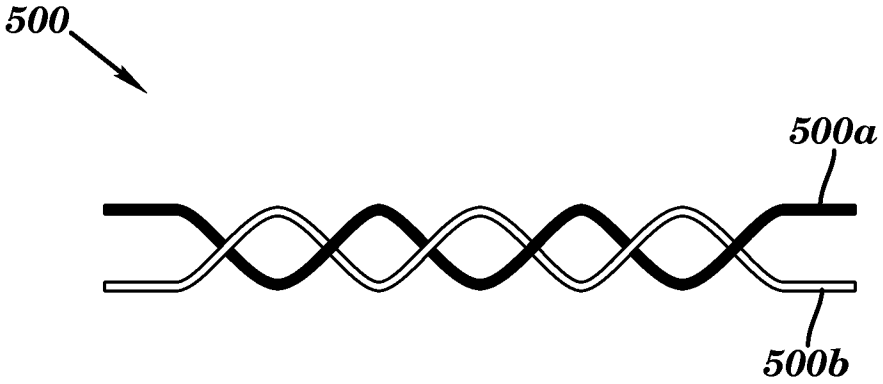
FIG. 5 is a side view of a twisted wire pair, in accordance with embodiments of the present invention.

Referring further to FIG. 5, there is seen a side view of a twisted wire pair 500 used in a winding structure for an RF transformer, in accordance with embodiments of the present invention. Twisted wire pair 500 comprises a center twisted winding of a matching transformer. Twisted wire pair 500 of FIG. 5 may be used for RF transformer 600*a* of FIG. 6A and/or RF transformer 600*b* of FIG. 6B as described, infra. Twisted wire pair 500 comprises a wire portion 500*a* twisted with a wire portion 500*b* and depending on a performance of parameters (such as, inter alia, isolation, insertion loss, return loss, etc.), a number of twists may be adjusted. Twisted wire pair 500 of FIG. 5 may be placed as a middle turn of a winding structure on a ferrite core (i.e., as illustrated in FIGS. 6A and 6B).

Figure 6B:
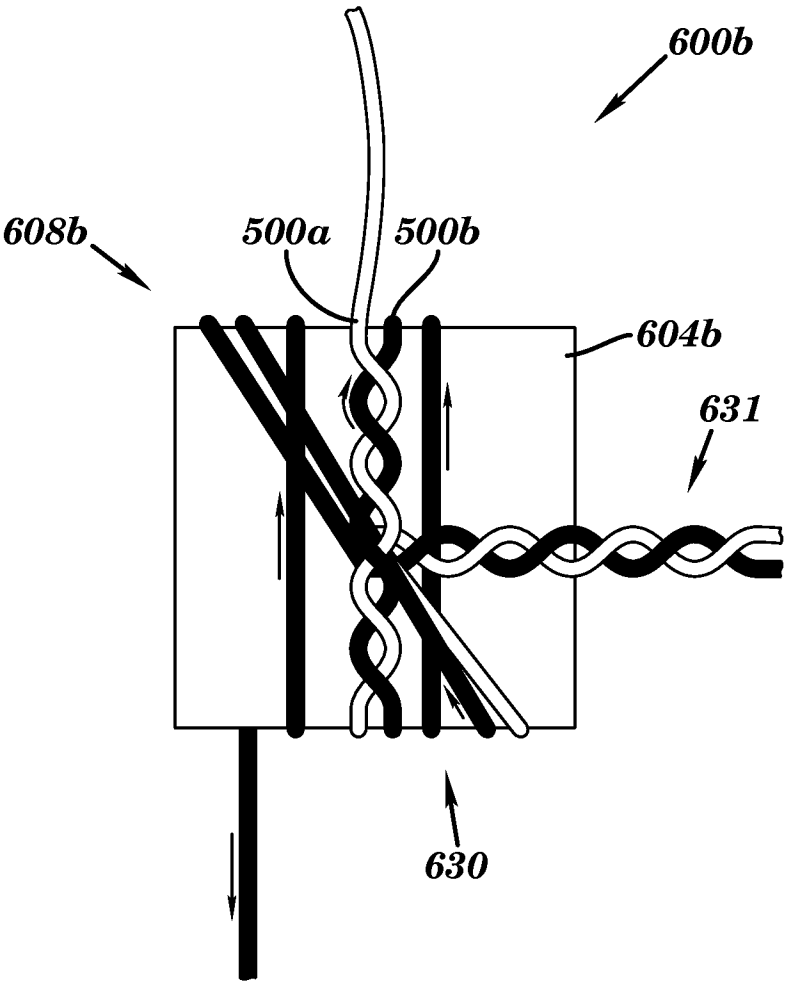
FIG. 6B is a side view of an RF transformer comprising multiple twisted wire pairs, in accordance with embodiments of the present invention.
Figure 6A:
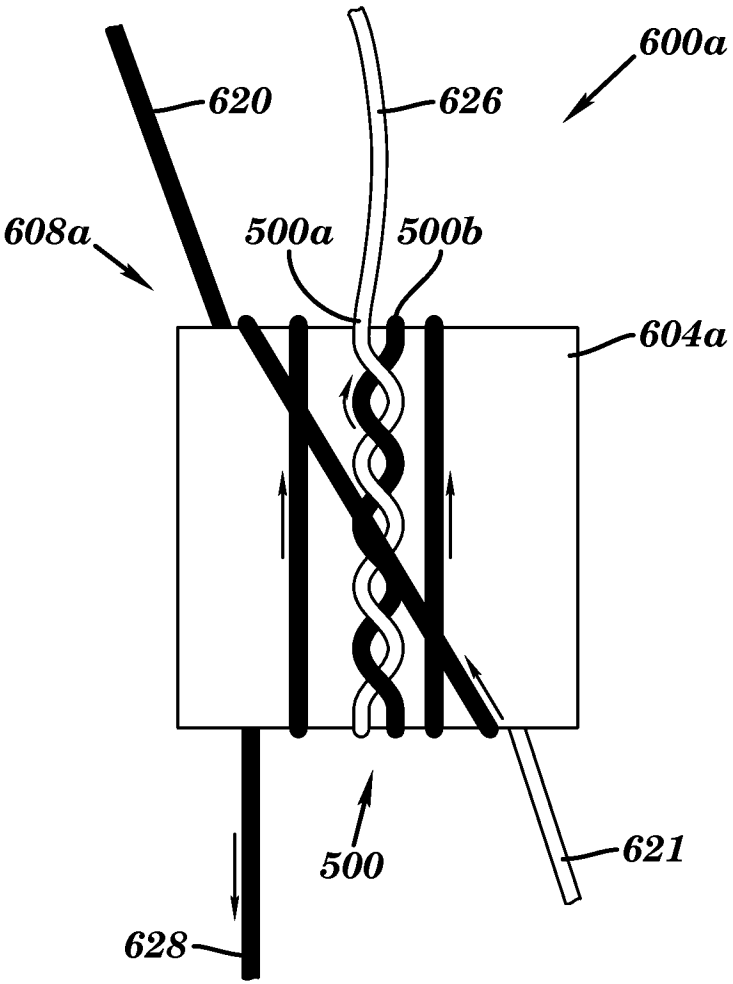
FIG. 6A is a side view of an RF transformer comprising a twisted wire pair, in accordance with embodiments of the present invention.

Referring further to FIG. 6A, there is seen a side view of an RF transformer 600*a* comprising a winding structure 608*a*, in accordance with embodiments of the present invention. RF transformer 600*a* (i.e., matching transformer) illustrates common leads (i.e., wires 620 and 621) before twisting the common leads together as illustrated in FIG. 6B, infra. RF transformer 600*a* comprises winding structure 608*a* formed around a ferrite core 604*a*. Ferrite core 604*a* may include multiple ferrite material types arranged in a non-uniform manner. Twisted wire pair 500 is formed by twisting wire portion 500*b* of wire 620 with wire portion 500*a* of wire 621. Wire 626 comprises an input wire and wire 628 comprises a ground wire. An orientation of multiple turns (i.e., of twisted wire pairs) on ferrite core 604*a* of the matching transformer enables specified performance parameters. For example, as a frequency rises at relatively low frequencies, a coupling is generally magnetic and facilitated by a ferrite material. As frequency rises through approximately 300 MHz, an effectiveness of the ferrite magnetic coupling decreases and a dominant coupling occurs via capacitive (proximity) coupling among the windings themselves.

Referring further to FIG. 6B, there is seen a side view of an RF transformer 600*b* comprising a winding structure 608*b*, in accordance with embodiments of the present invention. FIG. 6B shows a common end twisted wire pair 631 as a final look of the matching transformer. Twisted wire pair 631 includes tinned ends in order to removed insulation from the wires. Therefore, the tinned become a connection point between a matching transformer and a splitting transformer. Winding numbers show the orientation of the windings that also results in a broadband response. RF transformer 600*b* comprises winding structure 608*b* formed around a ferrite core 604*b*. Ferrite core 604*b* may include multiple ferrite material types arranged in a non-uniform manner. Winding structure 608*b* comprises a twisted wire pair 630 and 631 (i.e., common leads such as wires 620 and 621 twisted together) for a matching transformer. Providing twisted wire pairs at a center of a winding scheme increases a high frequency coupling to result in preferred loss characteristics and matching for a broadband spectrum from about 5 MHz to about 1700 MHz.

Referring further to FIGS. 7A-7J, there is seen a process for building RF transformer 600*b* (i.e., using side views) of FIG. 6B, in accordance with embodiments of the present invention.

Figure 7B:
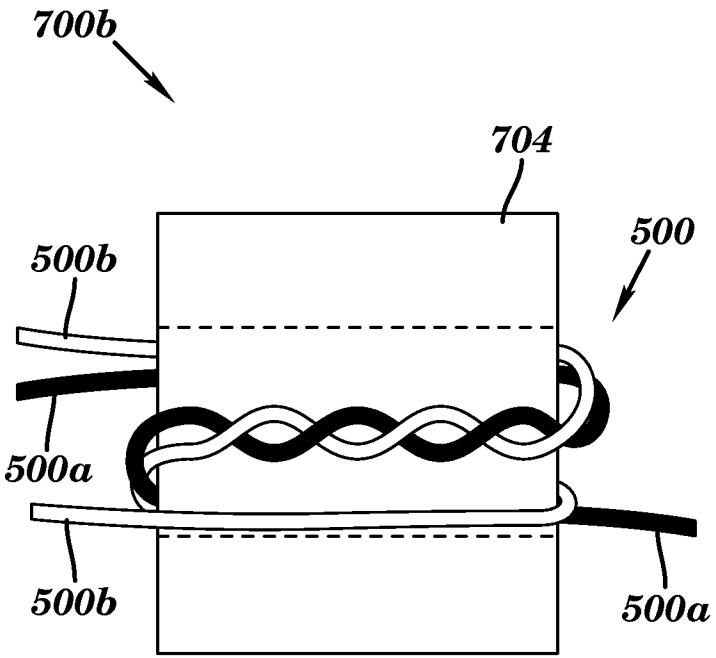
FIGS. 7A-7J illustrate a process for building the RF transformer of FIG. 6B, in accordance with embodiments of the present invention.
Figure 7A:
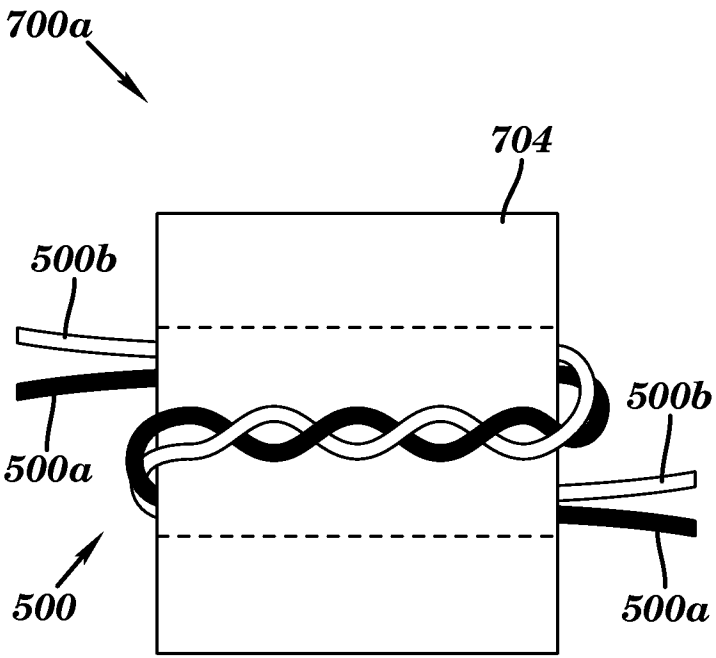

FIG. 7A illustrates a first step 700*a* for forming RF transformer 600*b* comprising twisted wire pair 500 (i.e., described in FIG. 5 and including a wire portion 500*a* twisted with a wire portion 500*b*) formed around ferrite core 704.

FIG. 7B illustrates a second step 700*b* for forming RF transformer 600*b*. The second step 700*b* includes forming another turn of wire portion 500*b* through a center of and around ferrite core 704.

Figure 7D:
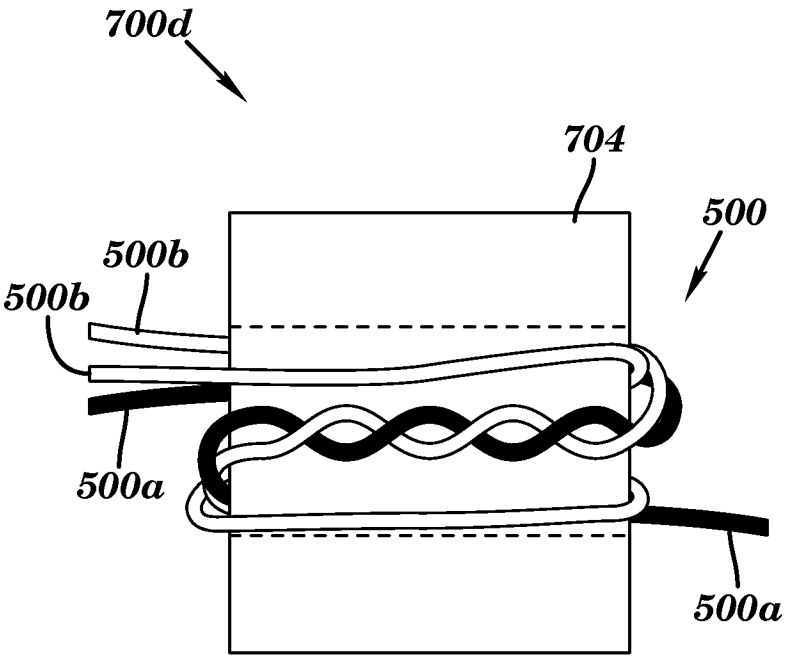
Figure 7C:
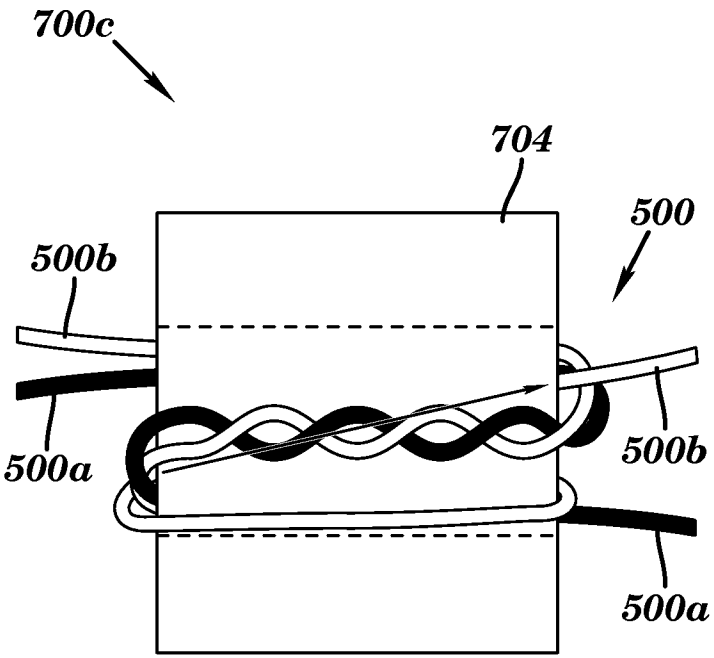

FIG. 7C illustrates a third step 700*c* for forming RF transformer 600*b*. The third step 700*c* includes forming another turn of wire portion 500*b* through the center of ferrite core 704.

FIG. 7D illustrates a fourth step 700*d* for forming RF transformer 600*b*. The fourth step 700*d* includes forming wire portion 500*b* across an outside portion of ferrite core 704.

Figure 7F:
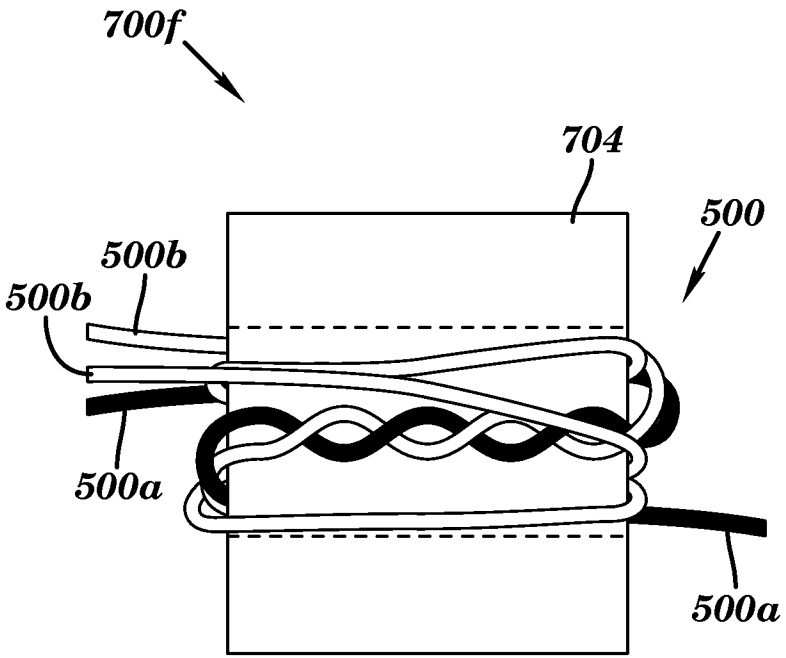
Figure 7E:
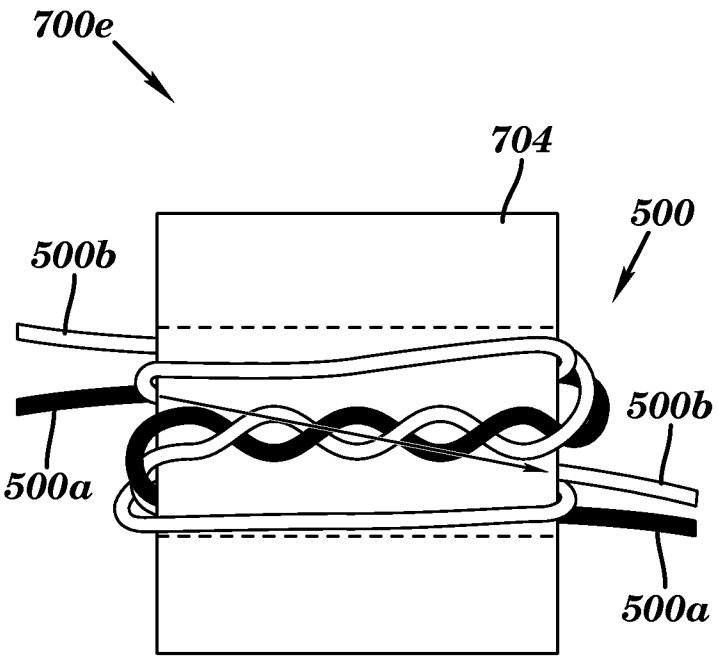

FIG. 7E illustrates a fifth step 700*e* for forming RF transformer 600*b*. The fifth step 700*e* includes forming another turn of wire portion 500*b* through the center of ferrite core 704.

FIG. 7F illustrates a sixth step 700*f* for forming RF transformer 600*b*. The sixth step 700*f* includes forming another turn of wire portion 500*b* across an outside portion of ferrite core 704 and across twisted wire pair 500.

Figure 7H:
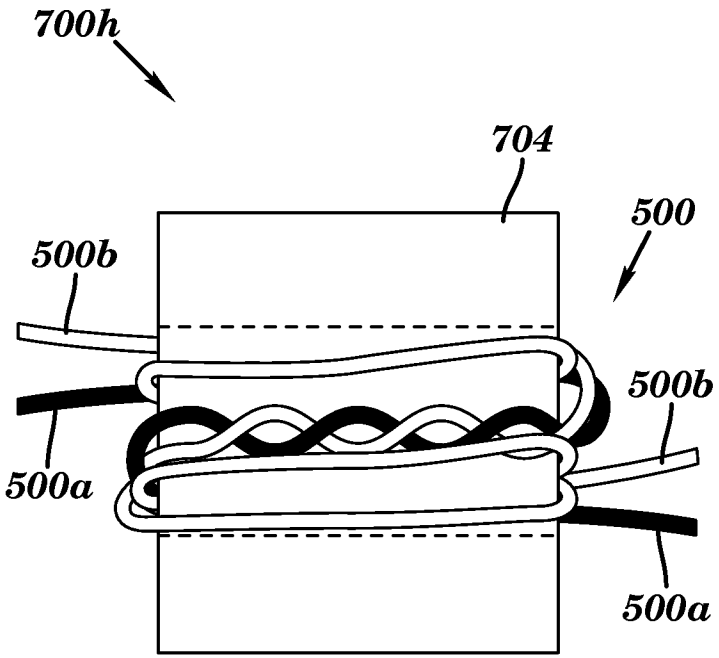
Figure 7G:
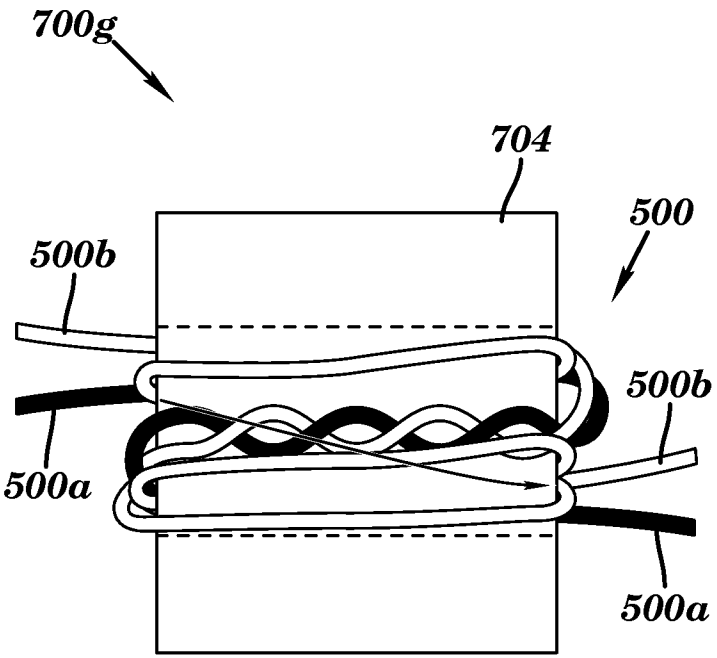

FIG. 7G illustrates a seventh step 700*g* for forming RF transformer 600*b*. The seventh step 700*g* includes forming another turn of wire portion 500*b* through the center of ferrite core 704.

FIG. 7H illustrates an eighth step 700*h* for forming RF transformer 600*b*. The eighth step 700*h* includes twisting wire portion 500*a* with wire portion 500*b*.

Figure 7J:
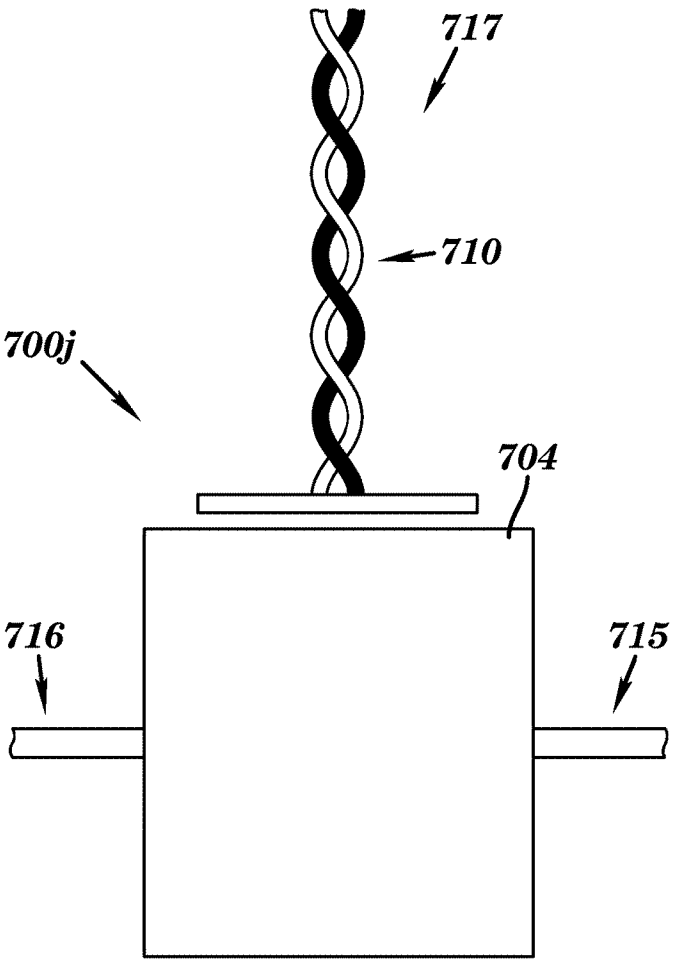
Figure 7I:
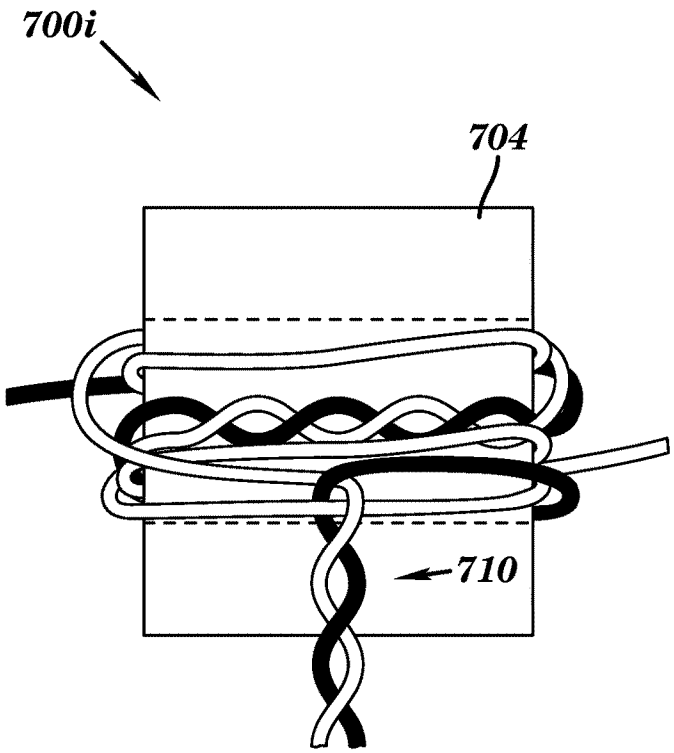

FIG. 7I illustrates a ninth step 700*i* for forming RF transformer 600*b*. The ninth step 700*i* includes twisting wire portion forming a tap portion 710.

FIG. 7J illustrates a tenth step 700*j* for forming RF transformer 600*b*. The tenth step includes tinning all exposed leads 715, 716, and 717.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

The invention claimed is:

1. A radio-frequency (RF) transformer, comprising:

a ferrite core having an outer surface;

a winding structure comprising a pair of conductive wires wound about a portion of the outer surface; and a spacer positioned at least partially between the ferrite core and the winding structure and configured to provide a gap between the ferrite core and the winding structure, wherein:

the pair of conductive wires comprises a first wire and a second wire, the pair of conductive wires forms a first twisted wire pair placed as a middle turn of the winding structure, and including a first plurality of consecutive windings disposed over the outer surface, for frequencies of signals rising through approximately 300 MHz, the placement of the first twisted wire pair on the ferrite core is configured to decrease effectiveness of magnetic coupling between the first twisted wire pair and the ferrite core, and to provide a dominant capacitive coupling among the first plurality of consecutive windings, a first turn of the second wire, but not the first wire, is formed through the center of the ferrite core and around an outside portion of the ferrite core, a second turn of the second wire, but not the first wire, is formed through the center of the ferrite core and around the outside portion of the ferrite core, the first twisted wire pair is positioned as the middle turn between the first and second turns of the second wire, the pair of conductive wires forms a second twisted wire pair including a second plurality of consecutive windings placed at a center of the winding structure and extending from the first twisted wire pair, and for signals in the winding structure having frequencies from about 5 MHz to about 1700 MHz, the placement of the second twisted wire pair at the center of the winding structure is configured to increase high frequency coupling.

2. The RF transformer of claim 1, wherein:

the first twisted wire pair comprises a first portion of the first wire of the pair of conductive wires twisted with a first portion of the second wire of the pair of conductive wires; and the winding structure further comprises:

a third turn of the second wire, but not the first wire, formed through the center of the ferrite core, around the outside portion of the ferrite core, wherein the third turn is formed across the first twisted wire pair;

a fourth turn of the second wire, but not the first wire, formed through the center of the ferrite core; and the second twisted wire pair is formed by twisting a second portion of the first wire with a second portion of the second wire.

3. The RF transformer of claim 1, wherein the second twisted wire pair is orthogonal to the first twisted wire pair.

4. The RF transformer of claim 1, wherein the ferrite core is a toroidal shaped member defining a ring disposed in a radial plane;

the first plurality of consecutive windings comprises a number of consecutive twists along the first twisted wire pair; and the first twisted wire pair is substantially coplanar with the radial plane of the toroidal shaped member.

5. The RF transformer of claim 1, wherein:

the ferrite core is a toroidal shaped member defining a ring disposed in a radial plane;

the toroidal shaped member defines a ring-shaped outer surface and a central opening;

the pair of conductive wires include a pair of untwisted wire portions between the first twisted wire pair and the second twisted wire pair; and at least one of the untwisted wire portions comprise a wire lead that wraps around the ring-shaped outer surface, and that crosses over the first twisted wire pair upon a subsequent revolution of the wire lead.

6. The RF transformer of claim 5, wherein the wire lead wraps around the ring-shaped outer surface to each side of the first twisted wire pair.

7. The RF transformer of claim 6, wherein:

a first wire of the pair of untwisted wire portions crosses over the first twisted wire pair of the winding structure.

8. The RF transformer of claim 6, wherein:

the pair of conductive wires includes a first untwisted wire lead and a second untwisted wire lead extending from the first twisted wire pair; and the first untwisted wire lead wraps around the ring-shaped outer surface of the toroidal shaped member and crosses over the first twisted wire pair upon a subsequent revolution of the first untwisted wire lead around the ring-shaped outer surface of the toroidal member.

9. The RF transformer of claim 1, wherein the winding structure comprises a ground wire wrapped around the outer surface of the ferrite core.

10. The RF transformer of claim 1, wherein:

the first twisted wire pair and the second twisted wire pair are solely placed over the outer surface of the ferrite core; and the second twisted wire pair extends from the first twisted wire pair at an angle that is orthogonal to the first twisted wire pair.

11. The RF transformer of claim 1, wherein the winding structure is solely comprised of a single pair of conductive wires forming the first twisted wire pair and the second twisted wire pair.

12. A radio-frequency (RF) transformer, comprising:

a ferrite core;

a winding structure formed around the ferrite core; and a spacer positioned at least partially between the ferrite core and the winding structure and configured to provide a gap between the ferrite core and the winding structure, wherein:

the winding structure comprises a first wire and a second wire, at least a portion of the first wire and the second wire are twisted to form a twisted wire pair comprising a plurality of consecutive twists configured to couple high bandwidth signals across the first wire of the twisted wire pair and the second wire of the twisted wire pair through a combination of magnetic coupling and capacitive coupling, the twisted wire pair is at a center of the winding structure and configured to increase the capacitive coupling among the plurality of consecutive twists as signal frequency rises, a first turn of the second wire, but not the first wire, is formed through the center of the ferrite core and around the outside portion of the ferrite core, and a second turn of the second wire, but not the first wire, is formed through the center of the ferrite core and around the outside portion of the ferrite core.

13. The RF transformer of claim 12, wherein the winding structure further comprises:

a third turn of the second wire, but not the first wire, formed through the center of the ferrite core and around the outside portion of the ferrite core, wherein the third turn is formed across the twisted wire pair;

a fourth turn of the second wire formed through the center of the ferrite core; and a second twisted wire pair formed by twisting another portion of the first wire with another portion of the second wire.

14. The RF transformer of claim 12, wherein the ferrite core is configured to couple low bandwidth signals across the first wire and the second wire such that the magnetic coupling decreases as a signal frequency of the signals rises through approximately 300 MHz.

15. The RF transformer of claim 12, wherein the winding structure further comprises a second twisted wire pair orthogonal to the first twisted wire pair, the second twisted wire pair comprises another portion of the first wire twisted with another portion of the second wire.

16. The RF transformer of claim 12, wherein the twisted wire pair is positioned between the first turn and the second turn.

17. The RF transformer of claim 16, wherein neither the first turn nor the second turn is positioned at least partially over the twisted wire pair.

18. The RF transformer of claim 16, wherein a third turn of the second wire, but not the first wire, is formed through the center of the ferrite core and around the outside portion of the ferrite core.

19. The RF transformer of claim 18, wherein the third turn is positioned at least partially over the twisted wire pair.

20. The RF transformer of claim 12, wherein the spacer further comprising:

a first spacer extending radially-outward from the ferrite core; and a second spacer extending axially-outward from the ferrite core.

21. The RF transformer of claim 20, wherein the first spacer is configured to space the first wire apart from the ferrite core, and wherein the second spacer is configured to space the second wire apart from the ferrite core.

22. The RF transformer of claim 20, wherein the first spacer is configured to space the second wire apart from the ferrite core, and wherein the second spacer is configured to space the first wire apart from the ferrite core.

23. A method for building a radio-frequency (RF) transformer, comprising:

forming a first twisted wire pair at least partially around a ferrite core by forming a plurality of consecutive twists of a portion of a first wire and a portion of a second wire;

positioning a spacer at least partially between the ferrite core and the first twisted wire pair to provide a gap between the ferrite core and the first twisted wire pair;

forming a first turn of the second wire, but not the first wire, through a center of the ferrite core and around an outside portion of the ferrite core;

forming a second turn of the second wire, but not the first wire, through the center of the ferrite core and around the outside portion of the ferrite core, wherein the first twisted wire pair is positioned between the first and second turns;

forming a third turn of the second wire, but not the first wire, through the center of the ferrite core and around the outside portion of the ferrite core, wherein the third turn is formed across the first twisted wire pair;

forming a fourth turn of the second wire through the center of ferrite core; and forming a second twisted wire pair by twisting a second portion of the first wire with a second portion of the second wire.

24. The method of claim 23, wherein forming the first twisted wire pair comprises configuring the plurality of consecutive twists to couple low bandwidth signals across the first wire and the second wire through magnetic coupling that decreases as a frequency of the signals rises through approximately 300 MHz.

25. The method of claim 23, wherein forming the first twisted wire pair comprises:

configuring the plurality of consecutive twists to couple high bandwidth signals across the first wire and the second wire through a combination of magnetic coupling and capacitive coupling; and configuring the plurality of consecutive twists to generate a capacitive magnitude of the capacitive coupling associated with high bandwidth signals that is proportional to a number of the plurality of the consecutive twists such that the capacitive magnitude proportionally increases as the number of the plurality of the consecutive twists increases.

26. The method of claim 23, wherein forming the second twisted wire pair comprises forming the second twisted wire pair generally orthogonally to the first twisted wire pair.

27. The method of claim 23, further comprising forming a pair of wire leads extending from the first twisted wire pair.

* * * * *